US008997897B2

(12) United States Patent
De Reynal

(10) Patent No.: US 8,997,897 B2
(45) Date of Patent: Apr. 7, 2015

(54) IMPREGNATED DIAMOND STRUCTURE, METHOD OF MAKING SAME, AND APPLICATIONS FOR USE OF AN IMPREGNATED DIAMOND STRUCTURE

(75) Inventor: Michel De Reynal, Arthez de Bearn (FR)

(73) Assignee: Varel Europe S.A.S., Carrollton, TX (US)

( * ) Notice: Subject to any disclaimer, the term of this patent is extended or adjusted under 35 U.S.C. 154(b) by 340 days.

(21) Appl. No.: 13/491,762

(22) Filed: Jun. 8, 2012

(65) Prior Publication Data

US 2013/0330139 A1 Dec. 12, 2013

(51) Int. Cl.

| | |
|---|---|
| ***E21B 10/00*** | (2006.01) |
| ***B24D 18/00*** | (2006.01) |
| ***B24D 99/00*** | (2010.01) |

(52) U.S. Cl.

CPC ..... *B24D 18/0009* (2013.01); *B24D 18/0027* (2013.01); *B24D 99/005* (2013.01); *Y10T 408/34* (2015.01)

(58) Field of Classification Search

USPC ..... 175/374; 51/297; 451/527, 529, 533, 451/544

See application file for complete search history.

(56) References Cited

U.S. PATENT DOCUMENTS

| | | | |
|---|---|---|---|
| 2,371,489 | A | 3/1945 | Williams, Jr. |
| 3,316,073 | A | 4/1967 | Kelso |
| 4,574,004 | A | 3/1986 | Schmidt-Ott et al. |
| 4,719,979 | A | 1/1988 | Jones |
| 4,726,718 | A | 2/1988 | Meskin et al. |
| 4,770,907 | A | 9/1988 | Kimura |
| 4,913,247 | A | 4/1990 | Jones |
| 4,917,917 | A | 4/1990 | Yamamoto et al. |
| 4,943,488 | A | 7/1990 | Sung et al. |
| 5,011,514 | A | 4/1991 | Cho et al. |
| 5,025,873 | A | 6/1991 | Cerkovnik |
| 5,049,164 | A | 9/1991 | Horton et al. |
| 5,062,865 | A | 11/1991 | Chen et al. |
| 5,096,465 | A | 3/1992 | Chen et al. |
| 5,143,523 | A | 9/1992 | Matarrese |
| 5,147,001 | A | 9/1992 | Chow et al. |
| 5,151,107 | A | 9/1992 | Cho et al. |
| 5,405,573 | A | 4/1995 | Clark et al. |
| 6,102,140 | A | 8/2000 | Boyce et al. |

(Continued)

FOREIGN PATENT DOCUMENTS

| | | | |
|---|---|---|---|
| EP | 0012631 | A1 | 6/1980 |
| EP | 1297928 | A1 | 4/2003 |
| GB | 1014295 | A | 12/1965 |

*Primary Examiner* — William P Neuder

(74) *Attorney, Agent, or Firm* — Gardere Wynne Sewell LLP; Andre M. Szuwalski

(57) ABSTRACT

A layer of matrix powder is deposited within a mold opening. A layer of super-abrasive particles is then deposited over the matrix powder layer. The super-abrasive particles have a non-random distribution, such as being positioned at locations set by a regular and repeating distribution pattern. A layer of matrix powder is then deposited over the super-abrasive particles. The particle and matrix powder layer deposition process steps are repeated to produce a cell having alternating layers of matrix powder and non-randomly distributed super-abrasive particles. The cell is then fused, for example using an infiltration, hot isostatic pressing or sintering process, to produce an impregnated structure. A working surface of the impregnated structure that is oriented non-parallel (and, in particular, perpendicular) to the super-abrasive particle layers is used as an abrading surface for a tool.

27 Claims, 6 Drawing Sheets

(56) References Cited

U.S. PATENT DOCUMENTS

| | | | | |
|---|---|---|---|---|
| 6,170,583 | B1 | 1/2001 | Boyce | |
| 6,171,709 | B1 | 1/2001 | Koizumi et al. | |
| 6,209,420 | B1 * | 4/2001 | Butcher et al. | 76/108.2 |
| 6,238,280 | B1 | 5/2001 | Ritt et al. | |
| 6,286,498 | B1 | 9/2001 | Sung | |
| 6,394,202 | B2 | 5/2002 | Truax et al. | |
| 6,454,027 | B1 | 9/2002 | Fang et al. | |
| 6,537,140 | B1 | 3/2003 | Miller et al. | |
| 6,655,481 | B2 | 12/2003 | Findley et al. | |
| 6,679,243 | B2 * | 1/2004 | Sung | 125/12 |
| 6,742,611 | B1 | 6/2004 | Illerhaus et al. | |
| 6,843,333 | B2 | 1/2005 | Richert et al. | |
| 7,124,753 | B2 * | 10/2006 | Sung | 125/12 |
| 7,350,599 | B2 | 4/2008 | Lockwood et al. | |
| 7,377,477 | B2 * | 5/2008 | Lucek et al. | 249/114.1 |
| 7,497,280 | B2 | 3/2009 | Brackin et al. | |
| 7,776,256 | B2 | 8/2010 | Smith et al. | |
| 7,802,495 | B2 | 9/2010 | Oxford et al. | |
| 8,104,464 | B2 * | 1/2012 | Sung | 125/12 |
| 2002/0194955 | A1 | 12/2002 | Fang et al. | |
| 2003/0084894 | A1 | 5/2003 | Sung | |
| 2004/0112359 | A1 | 6/2004 | Sung | |
| 2004/0154840 | A1 | 8/2004 | Azar et al. | |
| 2004/0235406 | A1 | 11/2004 | Duescher | |
| 2006/0081402 | A1 | 4/2006 | Lockwood et al. | |
| 2007/0102198 | A1 | 5/2007 | Oxford et al. | |
| 2007/0102199 | A1 | 5/2007 | Smith et al. | |
| 2008/0202821 | A1 | 8/2008 | McClain et al. | |
| 2008/0282618 | A1 | 11/2008 | Lockwood | |
| 2010/0122853 | A1 | 5/2010 | Scott et al. | |
| 2010/0187011 | A1 | 7/2010 | Jurica et al. | |
| 2010/0230174 | A1 | 9/2010 | Scott et al. | |
| 2012/0005966 | A1 | 1/2012 | Cleboski et al. | |
| 2013/0267154 | A1 * | 10/2013 | Sung | 451/443 |
| 2013/0273820 | A1 * | 10/2013 | Sung | 451/443 |

* cited by examiner

IMPREGNATED DIAMOND STRUCTURE, METHOD OF MAKING SAME, AND APPLICATIONS FOR USE OF AN IMPREGNATED DIAMOND STRUCTURE

BACKGROUND

1. Technical Field

The present invention relates generally to an abrading structure (such as a construct), and more particularly to the making of an abrading structure including impregnated diamond.

2. Description of Related Art

Prior art impregnated diamond structures (also known as constructs) are made using a random distribution of grit or small carat weight diamond granules within a cell of tungsten carbide powder. The diamond may be natural or synthetic. A hot isostatic pressing, sintering or binder infiltration process is then performed to fuse the tungsten carbide powder and retain the randomly distributed diamond. The resulting structure, which is sometimes referred to in the art as a diamond impregnated construct or segment, may then be used in an abrading tool. One example of such an abrading tool is an earth boring drill bit which is constructed by casting the constructs into a drill bit body, or alternatively attaching the constructs (using, for example, a brazing process) to the drill bit body. In other abrading applications, the constructs may be formed (by casting or attaching processes) to a tool body for use in grinding, abrading or other machining operations.

As a specific example, diamonds are mixed with matrix powder and binder into a paste-like material. The commonly known powder metallurgy process is used where the matrix powder comprises a mixture of tungsten and tungsten carbide and the binder material is a copper alloy. The paste is formed in a mold to a desired shape of the construct, and heat is applied to support binder infiltration and formation of the construct. Within the construct, the included diamond is suspended near and on the external surface of the construct and is randomly distributed. Such a random distribution, however, implies an irregular diamond distribution including areas with diamond clusters, areas of lower diamond concentration, and even areas that are void of diamond content.

Historically, the random distribution of diamond content within impregnated diamond constructs was viewed as desirable. The reason for this was that fresh cutting diamond was constantly being exposed as the fused tungsten carbide matrix surrounding the diamond particles was worn away during the abrading, grinding, machining, or cutting process for which the construct was being used. However, areas of the construct with diamond clusters may lack sufficient matrix material to support diamond retention during tool operation, while areas of low or no diamond content tend to exhibit poor wear properties. Additionally, constant exposure of fresh cutting diamond allows for an accompanying random distribution of matrix material striations trailing behind the exposed diamond particles. This results in a clogged interface between the construct and the surface of the target material (such as a rock formation in an earth drilling application). These striations also limit the depth of cut, and thereby slow penetration of the construct into the work target. The striations further reduce the ability of cooling fluids to carry heat away from the workface. Excess heat build-up at the workface tends to accelerate diamond failure and wear of the tungsten carbide matrix. Thus, it is now understood that the failure of prior art constructs with randomly distributed diamond is a direct result of the presence of that randomly distributed diamond in the construct.

There is a need in the art for an improved diamond construct which addresses the foregoing, and other, problems experienced with the making and use of randomly distributed impregnated diamond constructs.

SUMMARY

In an embodiment, a method comprises: (a) depositing a layer of matrix powder within a mold opening; (b) depositing a layer of super-abrasive particles over the matrix powder layer, said super-abrasive particles having a non-random distribution; (c) depositing a layer of matrix powder over the layer of super-abrasive particles; (d) repeating steps (b) and (c) to produce a cell having a plurality of alternating matrix powder and super-abrasive particle layers; and (e) fusing the cell to produce an impregnated structure for use as a segment or construct.

The super-abrasive particles may be placed on the matrix powder layer at desired locations in the non-random distribution. Alternatively, the super-abrasive particles may be embedded within a material layer at locations in the non-random distribution, with the material layer deposited on the matrix powder layer. Still further, the super-abrasive particles may be retained in a screen layer at locations in the non-random distribution, with the screen layer deposited on the matrix powder layer.

The process for fusing the cell to produce an impregnated construct may comprise one of an infiltration, hot isostatic pressing or sintering process.

The matrix powder layer may have a non-uniform component distribution. For example, with a tungsten carbide matrix powder, the layer may have a region that is richer in tungsten and another region that is richer in carbide.

In a preferred implementation, the impregnated construct is attached to a tool body.

In an embodiment, an apparatus comprises: a fused unitary matrix body embedding plural layers of super-abrasive particles; wherein each layer of super-abrasive particles comprises a plurality of super-abrasive particles arranged in the layer with a non-random distribution; and wherein the fused unitary matrix body has a side surface which is non-parallel to each layer of super-abrasive particles, said side surface being an abrading surface.

BRIEF DESCRIPTION OF THE DRAWINGS

Other features and advantages of the invention will become clear in the description which follows of several non-limiting examples, with reference to the attached drawings wherein.

DETAILED DESCRIPTION OF THE DRAWINGS

Reference is now made to FIGS. 1A-1F which show process steps for the fabrication of an impregnated diamond construct.

Figure 1A:
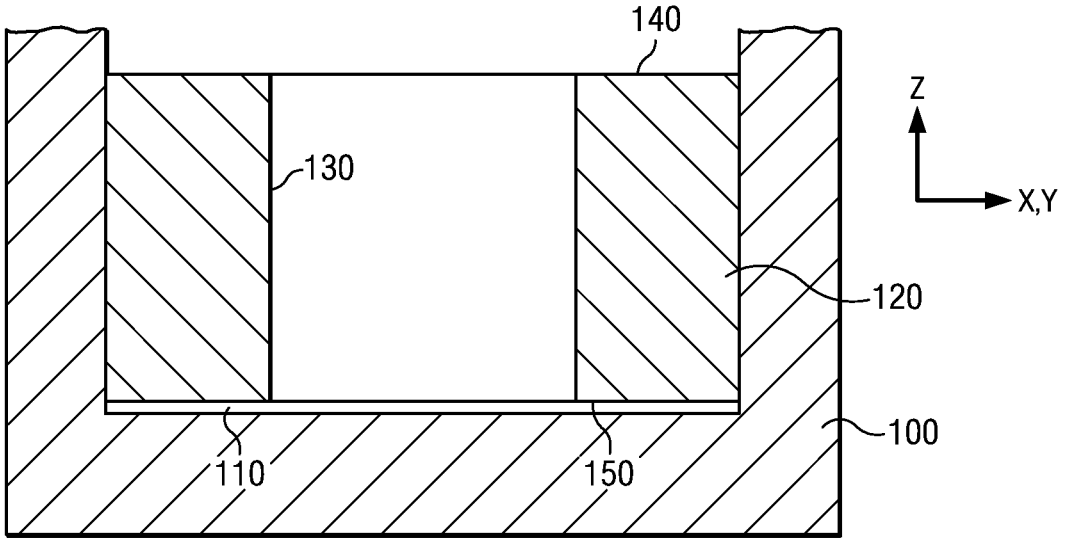
FIGS. 1A-1F show process steps for the fabrication of an impregnated diamond structure.

In FIG. 1A, a process container 100 is provided. The container 100 may be formed of a graphite material. The graphite material for the container 100 need not be of high quality. A layer of foil 110, for example a graphite foil such as that known in the art as "grafoil", is placed at the bottom of the container 100. A molding block 120 is then placed in the container 100. The molding block 120 is preferably made of a high quality graphite material. The graphite molding block 120 includes an opening 130 (only one shown in FIG. 1A to simplify the illustration) which extends completely through the molding block 120 from a top surface 140 to a bottom surface 150. The opening may have any desired cross-sectional shape (for example, a circular shape, a rectangular shape, a square shape). The foil 110 prevents a direct contact between the higher quality graphite molding block 120 and the lower quality graphite container 100, as well as preventing materials deposited in the opening 130 from being in direct contact with the lower quality graphite container 100.

Figure 1B:
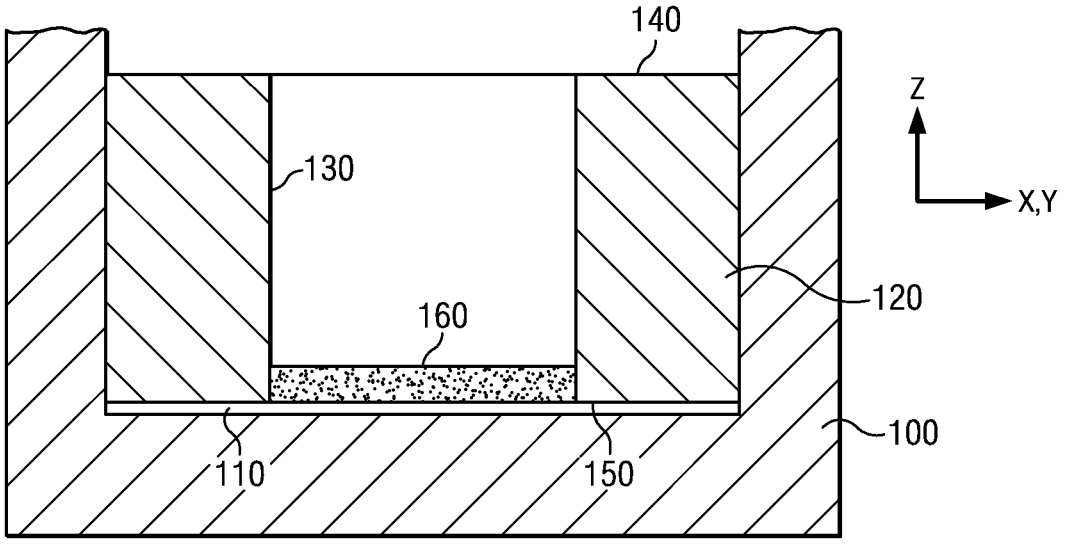

In FIG. 1B, a layer 160 of matrix powder is deposited in the opening 130. This layer 160 may have any desired thickness, for example within a range of 0.4 mm to 5 mm. In an exemplary implementation, the thickness of layer 160 is about 1.5 mm. The matrix powder is a standard tungsten carbide (W/WC) material known in the art of powdered metallurgy. If necessary, the layer 160 may be compacted or otherwise settled to substantially even its thickness.

Figure 1C:
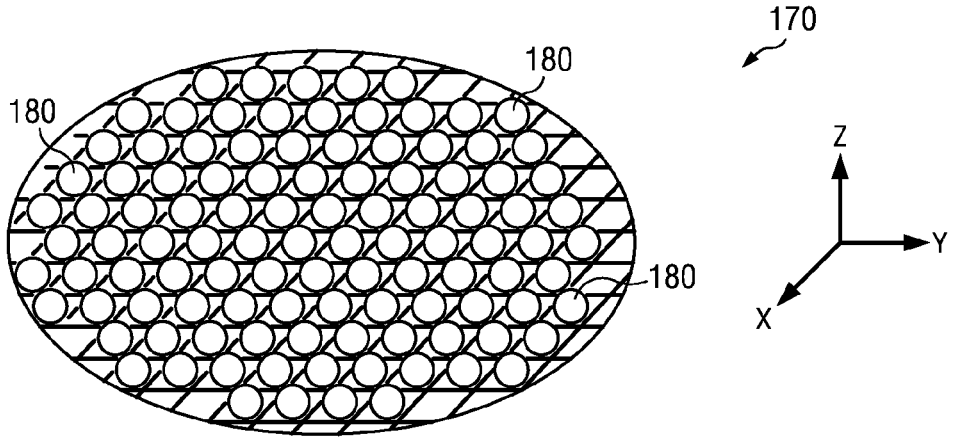

In FIG. 1C, a metal mesh 170 is prepared. The mesh may comprise a brass material, and in a preferred implementation the material is selected to match a binder material used in powdered metallurgy processing. The mesh 170 includes a plurality of regularly spaced openings whose size is slightly smaller than a super-abrasive particle size that is being used in this application. For example, the super-abrasive particles may have a size in the range 0.1 mm to 4 mm, it being preferred that all particles used have a substantially same size (it being further understood that acceptable particles may be found in a range, such as +/−1 mm, of a desired average size). An adhesive mechanism is provided with respect to the mesh 170 to secure super-abrasive particles at the mesh openings. That adhesive mechanism may comprise an adhesive material, such as glue, or may utilize other adhesive means including material deformability or magnetic attraction. A layer of super-abrasive particles are deposited on top of the mesh 170. Certain of those particles, referenced at 180, will be retained in the openings of the mesh 170 by the adhesive mechanism (for example, one super-abrasive particle seated per mesh opening). The non-retained particles are then removed. The mesh 170 is illustrated in FIG. 1C with a circular shape. This is by example only, and the shape of the mesh should match the cross-sectional shape of the opening 130.

Figure 1D:
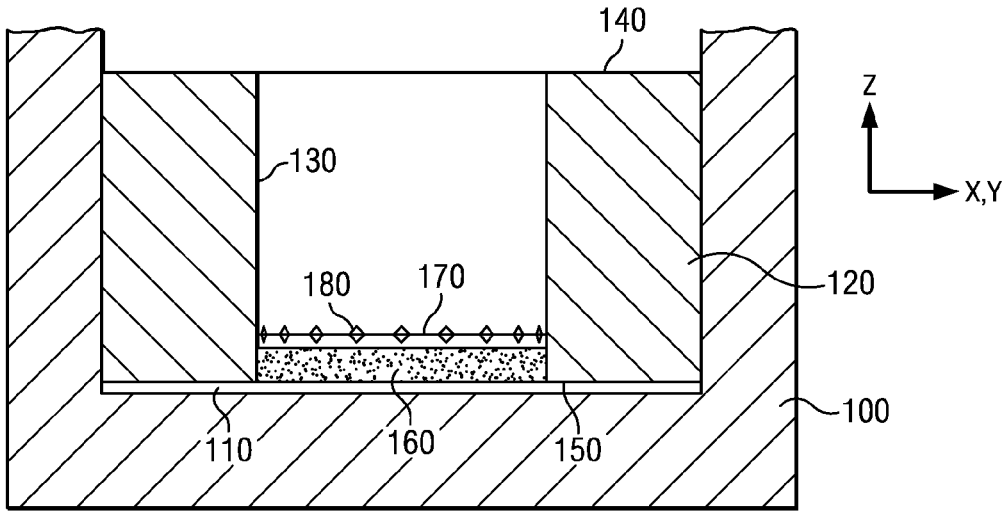

In FIG. 1D, the mesh 170 with retained super-abrasive particles 180 is placed in the opening 130 over and on top of the layer 160 of matrix powder. If necessary, the mesh 170 and the layer 160 may be compacted or otherwise settled so as to ensure a parallel layering within the opening 130 of the molding block 120.

In an embodiment, the mesh 170 may comprise a tungsten carbide screen. For example, a metal screen with a tungsten carbide cladding, such as that provided by Conforma Clad, Inc. of New Albany, Ind.

In an embodiment, the mesh 170 may comprise nickel alloy screen. This embodiment is advantageous as the nickel alloy material of the mesh can be the same nickel alloy material used as the binder material during infiltration.

Figure 1E:
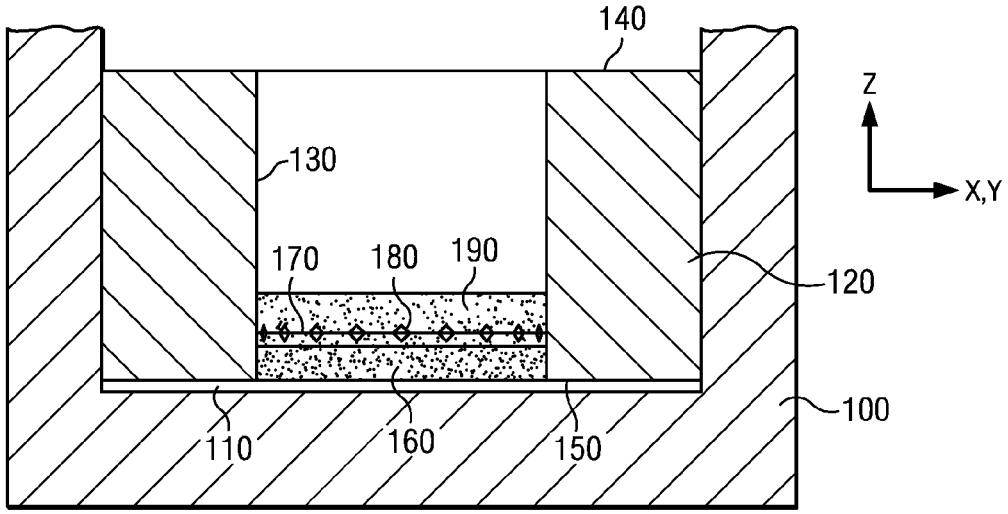

In FIG. 1E, a layer 190 of matrix powder is deposited. This layer 190 may have any desired thickness slightly greater than a desired spacing between layers of super-abrasive particles 180, for example within a range of 2 mm to 7 mm. The matrix powder is a standard tungsten carbide (W/WC) material known in the art or powdered metallurgy and like that used for the layer 160. If necessary, the layer 190, the mesh 170 and the layer 160 may be compacted or otherwise settled so as to ensure a parallel layering within the opening 130 of the molding block 120.

Figure 1F:
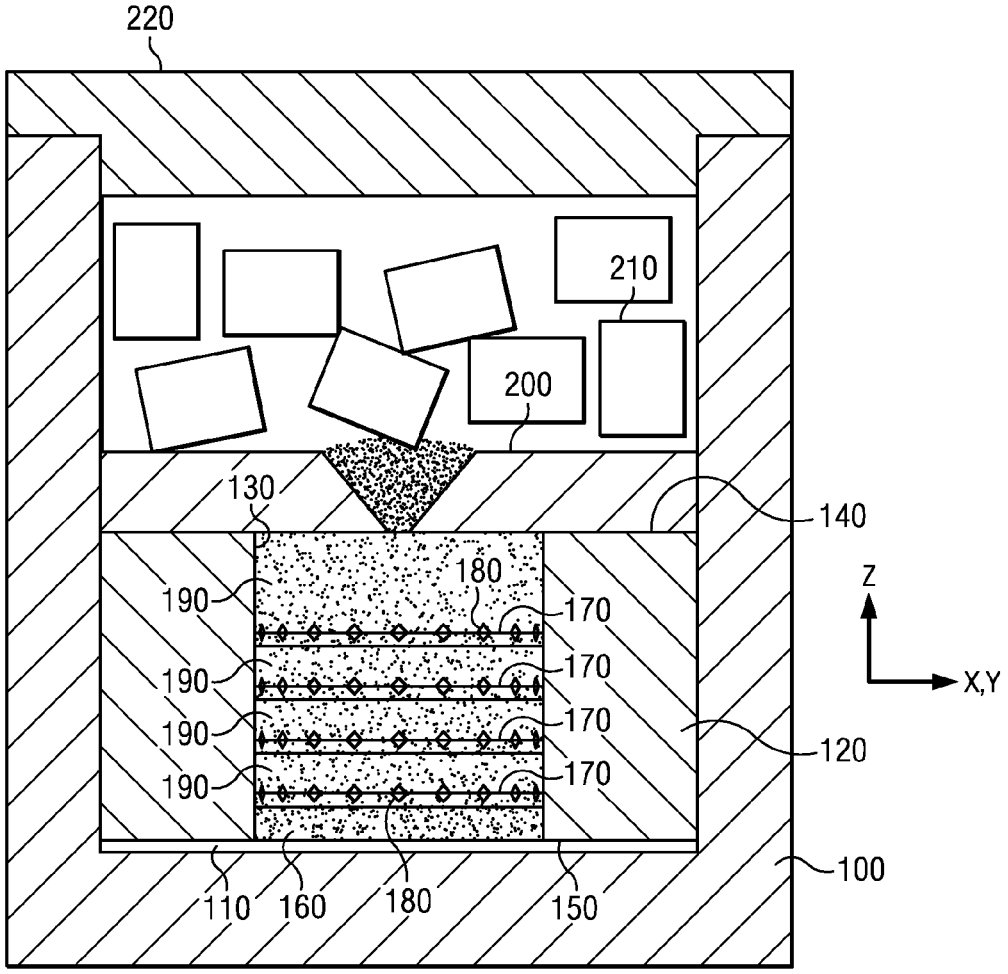

The processes described above and illustrated in FIGS. 1C, 1D and 1E are then repeated as many times as desired to provide a cell within the opening 130 of the molding block 120 which comprises a multi-layer structure. The multi-layer structure of the cell is comprised of alternating matrix powder layers 170/190 and layers of super-abrasive particles 180 (such as provided by the mesh 170 layers). As a result, the opening 130 is filled with a precision layered charge of super-abrasive particles 180. An exemplary implementation containing four layers of super-abrasive particles 180 (provided by four mesh 170 layers) alternating with five matrix powder layers 170/190 is shown in FIG. 1F. It will be noted that the last matrix powder layer 190 at the top of the cell is preferably provided with a thickness that substantially fills the remaining open volume of the opening 130 up to about the top surface 140 and can be made of easily machinable matrix material if necessary to help in shaping the final composite element.

A funnel 200 is provided over the graphite molding block 120 in alignment with the opening 130. Additional matrix powder of the type used for layers 160/190 fills the funnel 200. A borax powder, serving as a flux material, is added to the matrix powder in the funnel 200 if processed in oxidizing (normal) atmosphere. This borax step can be omitted if processed under hydrogen atmosphere or under vacuum condition. Binder material blocks 210 are then loaded within the container 100 above the funnel 200. The binder material may comprise, for example, brass (or any other suitable binder known in the powdered metallurgy art). A charcoal powder (idem) may also be added to the binder material blocks 210 (for the purpose of oxygen absorption so as to minimize oxidation within the container 100). A lid 220 is then provided to seal the process container 100. It is preferred that a relatively large and tall binder reservoir, containing more binder material than is needed, be used in the powdered metallurgy process to ensure that the opening 130 and its retained cell is completely infiltrated at a higher hydrostatic pressure (proportional to height of binder head).

The sealed process container 100 is then placed in a furnace at a temperature in excess of 1000° C. for a sufficient time to ensure complete binder infiltration of the cell within the opening 130. The furnace temperature and soaking time are preferably selected to ensure infiltration with minimal risk of graphitization of the super-abrasive particles 180. A water quenching operation is then performed after the soaking time expires.

Although a conventional powdered metallurgy process is described above for fusing the cell, it will be understood that other processes could be used for fusing the cell such as hot isostatic pressing or sintering. These processes are well known to those skilled in the art.

Figure 1G:
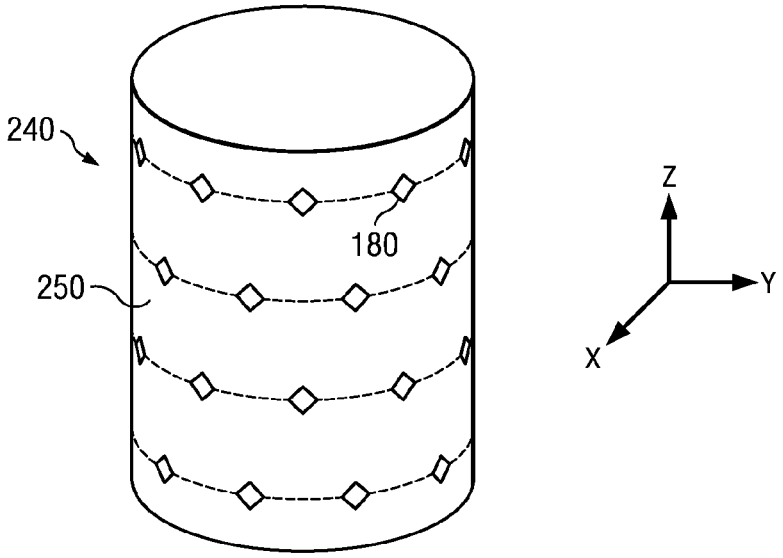
FIG. 1G is a perspective view of the fabricated impregnated diamond structure.

The fusing of the cell produces an impregnated structure 240, which is shown in FIG. 1G after post-furnace cleaning for slag and funnel removal, in each opening 130. Preferably, recovery of the structure 240 is accomplished without destroying the container 100 or block 120. The structure comprises a fused unitary matrix body embedding a plurality of super-abrasive particles, wherein those particles are arranged in a plurality of separate particle layers, and each particle layer comprises super-abrasive particles arranged with a non-random distribution. The term "unitary" is defined herein to mean that the fusing produces a matrix body of structure 240 which does not have a laminated or sandwiched structure. In other words, the fusing to a unitary matrix body has eliminated the presence of separate layers 160 and 190 of matrix material in favor on a single integral or unitary particle embedding matrix body. The structure 240 is illustrated in FIG. 1G with a solid cylindrical shape having a circular cross-section. This is by example only and is shown this way to conform to the circular shape of the mesh 170 shown in FIG. 1C. The structure 240 includes a side surface 250 formed from the fused layers 160/170/190, and thus the side surface is non-parallel, and in particular is perpendicular, to the layers of non-randomly distributed super-abrasive particles 180. This side surface 250 is preferably the working surface of the impregnated structure 240 (i.e., the surface which is applied against the work target for purposes of performing an abrasion). Exemplary super-abrasive particles 180 in four layers are also show in FIG. 1G exposed on the side surface 250, it thus being clear that the layers of super-abrasive particles embedded in the fused matrix body lie, in a preferred implementation, perpendicular to the working surface 250.

Impregnated structures 240 as shown in FIG. 1G and formed in accordance with the process of FIGS. 1A-1F, with diamond particles as the super-abrasive particles 180, were tested and shown to produce, in comparison to conventional impregnated constructs with a random diamond distribution, a nearly tenfold improvement in material removal rate with respect to a target material. The diamond particles were monocrystalline synthetic diamonds of about 65 mesh size with a silicon coating. The silicon coating was provided to ensure against diffusion of material from the mesh 170 into the diamond lattice and to delay the onset of diamond oxidation and graphitizing. The mesh 170 included 35 mesh size openings configured to individually seat the 65 mesh size diamonds. A glue type spray adhesive was applied to the mesh 170 prior to deposit of the diamonds, with the glue serving to retain the seated diamonds. The W/WC ratio for the matrix powder of the layers 160 and 190 was selected to provide a desired wear rate (i.e., abrasion resistance) and support diamond particle retention, the set ratio defining the rate at which the tungsten carbide of the structure 240 would erode and expose new diamonds.

In the testing of the constructed impregnated structure 240, the target material was a carborundum grinding wheel. A typical prior art impregnated construct with random diamond distribution could suitably be used to "dress" the surface of such a carborundum grinding wheel. The working surface 250 of the impregnated structure 240, however, was operable to wear away the grinding wheel completely in a time it would typically have taken the prior art impregnated construct to simply dress the outer surface of the wheel. It is believed that the engineered placement of super-abrasive diamond particles 180 in layers with a regular and repeating pattern (for example as provided by mesh 170) provides a substantial and demonstrated improvement in target material removal in comparison to typical prior art impregnated constructs with randomly distributed diamond.

Impregnated structures 240 fabricated in the manner described above embody several advantages over impregnated constructs (with randomly distributed diamond content) of the prior art. The controlled placement of diamond, for example in a regular and repeating pattern, within the structure produces a segment or construct having better exposure of the cutting layers, better cooling of the cutting face, and increased rates of penetration into the target material. Instances of clogging or overlapping striations are dramatically reduced or eliminated with the structures of the present invention. This contributes directly to an improved clearing of removed target material from the cutting face. Additionally, the structures of the present invention exhibit extended life due, at least in part, to better thermal characteristics (the diamond particles are not burned and the wear rate of the supporting tungsten carbide matrix is reduced).

The impregnated structures 240 are particularly useful in rock drilling bits. In this implementation, the structures 240 are deployed in radial blades or arrays. In an embodiment, the diamond layers of structures that are equally or near equally radially deployed from a bit center may be slightly out of axial alignment. However, the improved depth of cut and improved facial cleaning which is characteristic of use of the impregnated structures 240 in improved overall performance of the bit until such time as the current diamond layer is worn away. However, with multiple structures 240 installed on the bit, another diamond layer on another construct (deployed on another circumferential ring) provides another diamond layer to take over as the primary cutting element for that zone of the bit face when the layer on another construct has been worn away.

Figure 2:
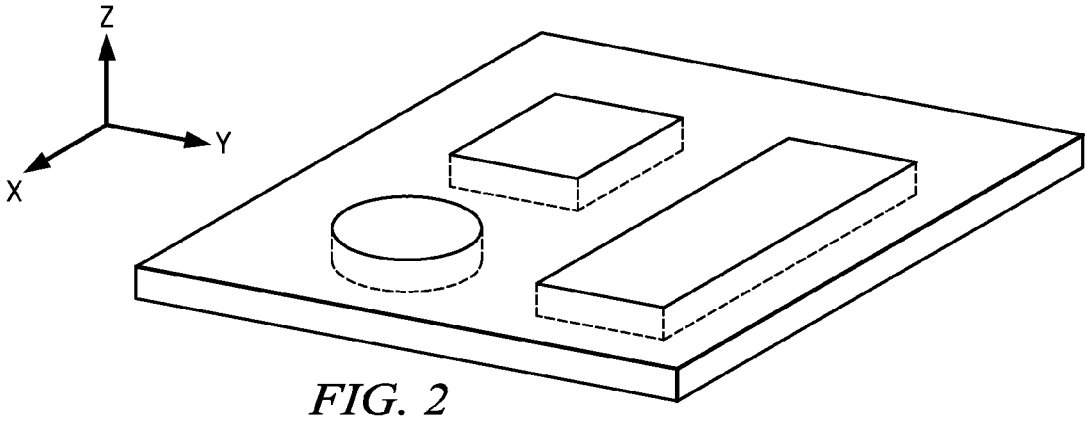
FIG. 2 is a perspective view of sheet of matrix powder.

With reference once again to FIG. 1B, the layer 160 of matrix powder may be provided in any of a number of forms. In one embodiment, the layer 160 is provided as a powdered deposit made into the opening 130. In another embodiment, the layer 160 is provided in a sheet format like that shown in FIG. 2 wherein the matrix powder is held together using an appropriate binder (such as a resin or organic binder) and rolled or pressed into a sheet having a desired thickness. The layer 160 may be cut from the sheet and installed into the opening 130. FIG. 2 illustrates a round shape, square shape and rectangular shape cut from the sheet material that can correspond to the cross-sectional shape of the opening 130 and the fabrication of an impregnated structure 240 having a corresponding cross-sectional shape.

It will be understood the layer 160 of matrix powder in opening 130 may be formed by one or more stacked sheets, such as with use of the sheet shown in FIG. 2.

Figure 3:
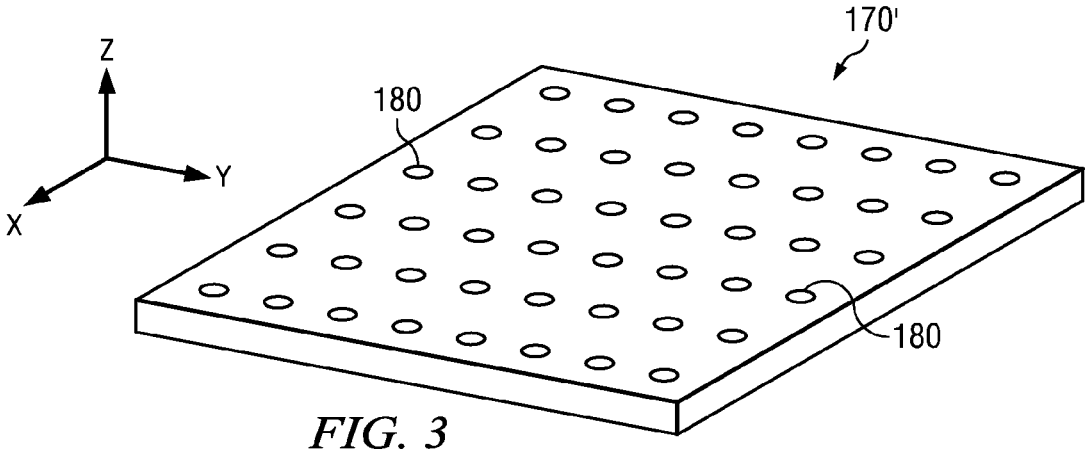
FIG. 3 is a perspective view a sheet supporting a layer of super-abrasive particles.

With reference once again to FIG. 1C, the layer with super-abrasive particles 180 may be provided in any of a number of forms. In the embodiment of FIG. 1C, the layer is provided through the use of a mesh 170. FIG. 3 illustrates another embodiment with a layer 170' of sheet material which retains the super-abrasive particles 180. The sheet layer 170' accordingly takes the place of the mesh 170 in the disclosed process. The layer installed in opening 130 in FIG. 1D may be cut from the sheet layer 170'. As shown in FIG. 2, the shape of the cut may be round, square, rectangular, or other to correspond to the cross-sectional shape of the opening 130 and the fabrication of an impregnated structure 240 having a corresponding cross-sectional shape. The sheet material may, in an embodiment, embed the super-abrasive particles 180. In another embodiment, the surface of the sheet is dimpled, with the dimples sized to seat the super-abrasive particles 180 (in a manner analogous to the mesh). In another embodiment, pick and place and embed technology known to those skilled in the art can be used to individually position super-abrasive particles 180 with the desired regular and repeating pattern on the sheet. An adhesive mechanism, like that provided with the mesh 170, could be used with the dimpled sheet or pick and place operation. A pressing mechanism may be employed after placement of the super-abrasive particles 180 so as to press the particles into the sheet. The sheet may be made of any suitable material (including metallic or non-metallic materials).

The super-abrasive particles are arranged in the layer with a non-random distribution. In a preferred embodiment, the arrangement of super-abrasive particles is regular and repeating, for example such as provided with a matrix format of columns and rows with a particle or grain or granule of super-abrasive material positioned at the intersection of each column and row. It will be understood, however, that where multiple layers of a super-abrasive particles are provided in the construction of the impregnated structure 240, the multiple layers need not have identical non-random arrangements of super-abrasive particles. The non-random distribution of super-abrasive particles may have a certain orientation. It will be understood, however, that with multiple layers of a super-abrasive particles provided in the construction of the impregnated structure 240, the multiple layers need not have identical orientations.

Although diamond particles (natural or synthetic) are preferred for the super-abrasive particles, it will be understood that other forms of super-abrasive particles could be used including, for example, cubic boron nitride particles.

With reference once again to FIG. 1E, the layer 190 of matrix powder may be provided in any of a number of forms. In one embodiment, the layer 190 is provided as a powdered deposit made into the opening 130. In another embodiment, the layer 190 is provided in a sheet format like that shown in FIG. 2 wherein the matrix powder is held together using an appropriate binder (such as a resin or organic binder) and rolled or pressed into a sheet having a desired thickness. The layer 190 may be cut from the sheet and installed into the opening 130. FIG. 2 illustrates a round shape, square shape and rectangular shape cut from the sheet material that can correspond to the cross-sectional shape of the opening 130 and the fabrication of an impregnated structure 240 having a corresponding cross-sectional shape.

It will be understood the layer 190 of matrix powder in opening 130 may be formed by one or more stacked sheets, such as with use of the sheet shown in FIG. 2.

Figure 4:
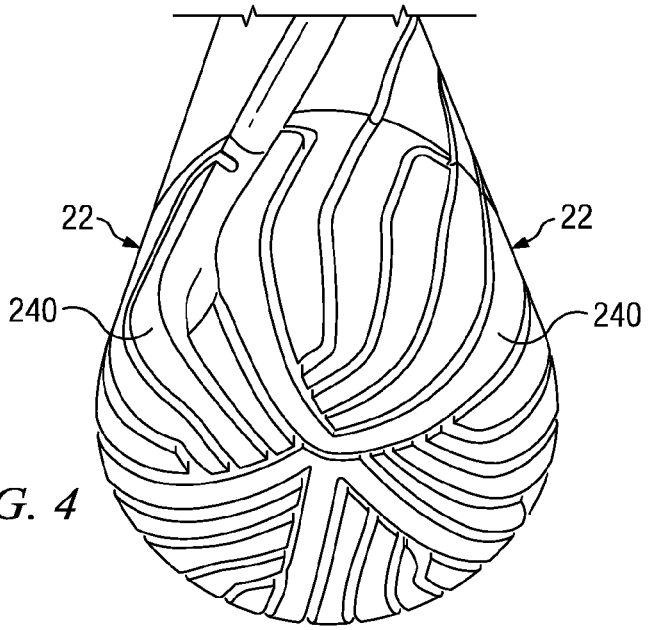
FIGS. 4-7 illustrate perspective views of impregnated drill bits including abrasive structures formed from an impregnated diamond structure like that of FIG. 1G.

With reference once again to FIG. 1A, the opening 130 may have (in plan view) any desired size and shape corresponding to a desired size and shape (in cross view) of the impregnated structure 240 that is being fabricated. The opening 130 may, accordingly, have a size and shape which conforms to the curved outer surface of a drill bit like that shown in FIG. 4. The drill bit of FIG. 4 is of the impregnated-type known to those skilled in the art an including a plurality of impreg blades 22. Each of those blades may be formed of an impregnated structure 240. The opening 130 in the block 120 would be sized and shaped to correspond to the size and shape of the impreg blade 22 (where a depth of the opening 130 corresponds to a width of the blade and a width of the opening 130 corresponds to a depth of the blade). The working surface 250 of the impregnated structure 240 would correspond to the outer formation-engaging surface of the impreg blade 22.

Figure 5:
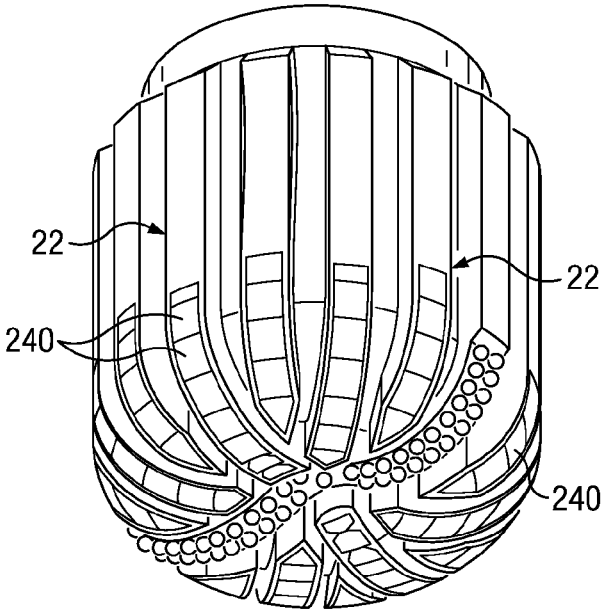

An alternative implementation for an impregnated drill bit is shown in FIG. 5. The drill bit of FIG. 5 illustrates a plurality of blades 22, however, in this implementation the blades are matrix blades as known in the art. Attached to an outer surface of each blade 22, or alternatively recess mounted in the outer surface of each blade 22, are a plurality of impregnated segments, each segment made from a structure 240. The opening 130 in the block 120 would be sized and shaped to correspond to the size and shape of the desired impregnated segment (where a depth of the opening 130 corresponds to a width of the segment and a width of the opening 130 corresponds to a depth of the segment). The working surface 250 of the impregnated structure 240 would correspond to the outer formation-engaging surface of the segment on the blade 22.

With reference once again to FIGS. 1B and 1E, the layers 160 and 190 of matrix powder may have a non-uniform component distribution. For example, in the preferred implementation where the matrix powder comprises a tungsten carbide powder, the layer 160 may have a non-uniform varying ratio of the tungsten (W) and tungsten carbide (WC) component parts of the powder (in the x-y plane). Thus, while the entire layer 160/190 comprises a tungsten carbide matrix powder, certain regions of the layer may be richer in carbide while other regions of the layer may be richer in tungsten. This is accomplished by varying the volume of tungsten compared to carbide within certain regions of the layer 160/190. The effect of this non-uniform component distribution within the layer 160/190 is to create a variable wear rate. For example, regions of the layer which are tungsten rich (i.e., have a relatively higher tungsten volume) will wear faster than regions of the layer which are carbide rich (i.e., have a relatively higher carbide volume), and this increased wear serves to increase the exposure of the super-abrasive particles 180 during use of the structure 240. An improvement in penetration rate, as well as an increase in available face clearance (thus facilitating the evacuation of abraded particles freed from the target material), results.

It will further be understood that the layers 160 and 190 need not have a same component distribution for the matrix powder. Thus, one layer 160/190 may have a first component distribution, while another layer 160/190 has a different second component distribution (in the z-direction). For example, in the preferred implementation where the matrix powder comprises a tungsten carbide powder, one layer 160/190 may be tungsten rich while another layer 160/190 may be carbide rich. This produces a varying wear rate with respect to the z-direction of the structure 240 (in other words, a varying wear rate along the length of the working surface 250).

More specifically, with respect to an embodiment wherein layer 160/190 is made from a plurality of sub-layers, such as would be provided with the use of a plurality of sheets as described above, it will be understood that the sub-layers within each layer 160/190 need not have a same component distribution for the matrix powder. Thus, one or more sub-layers or sheets within a given layer 160/190 may have a first component distribution, while one or more other sub-layers or sheets within that same give layer 160/190 have a different second component distribution. For example, in the preferred implementation where the matrix powder comprises a tungsten carbide powder, one or more sub-layers or sheets within a given layer 160/190 may be tungsten rich while one or more other sub-layers or sheets within that same give layer 160/190 may be carbide rich. This produces a varying wear rate with respect to the depth of the structure 240, and more particularly a varying wear rate between super-abrasive particles as a function of length along the working surface 250.

FIGS. 1A-1E are not intended to illustrate actual views of the materials, apparatus, systems and/or methods in conjunction with the fabrication of impregnated diamond constructs, but rather are illustrative representations. The figures are not drawn to scale. Sizes, dimensions, thicknesses, and the like shown in the drawings may be exaggerated so as to more clearly illustrate the nature of the invention.

Although the preferred embodiment discussed above utilizes diamonds for the super-abrasive particles 180, it will be understood that any suitable super-abrasive particle could be substituted for the diamonds. Such super-abrasive particles may include thermally stable polycrystalline diamond (TSP) particles, cubic boron nitride (CBN) particles, a combination of diamond and CBN particles, or any other particle having similar material hardness properties.

The fabricated structure 240 may be utilized in any number of applications. In a preferred implementation, the fabricated structure 240 is used in a drilling tool. Examples of such use are provided below. It will be understood that the fabricated structure 240 could also find use in other cutting or abrading tools including, without limitation, grinders, dressing tools, saw blade, wire saws, and the like.

FIG. 4 illustrates a perspective view of an impregnated drill bit including a plurality of blades 22 formed from impregnated structures 240. In this implementation, the impregnated drill bit may be a molded structure in which the bit mold comprises the block 130 used to form the impregnated structure 240 as an integral component or feature of the bit/tool, and thus each formed impregnated structure 240 would define, at the completion of bit molding, one of the blades 22.

FIG. 5 illustrates a perspective view of an impregnated drill bit including a plurality of discrete abrasive segments attached to a body of the drill bit. In particular, the segments are shown to be attached to blade structures. Each abrasive segment is comprised of an impregnated structure 240. The structures 240 may be attached to the body of the drill bit, adjacent to each other and extending along the length of the blade, using brazing or furnacing techniques known to those skilled in the art.

Figure 6:
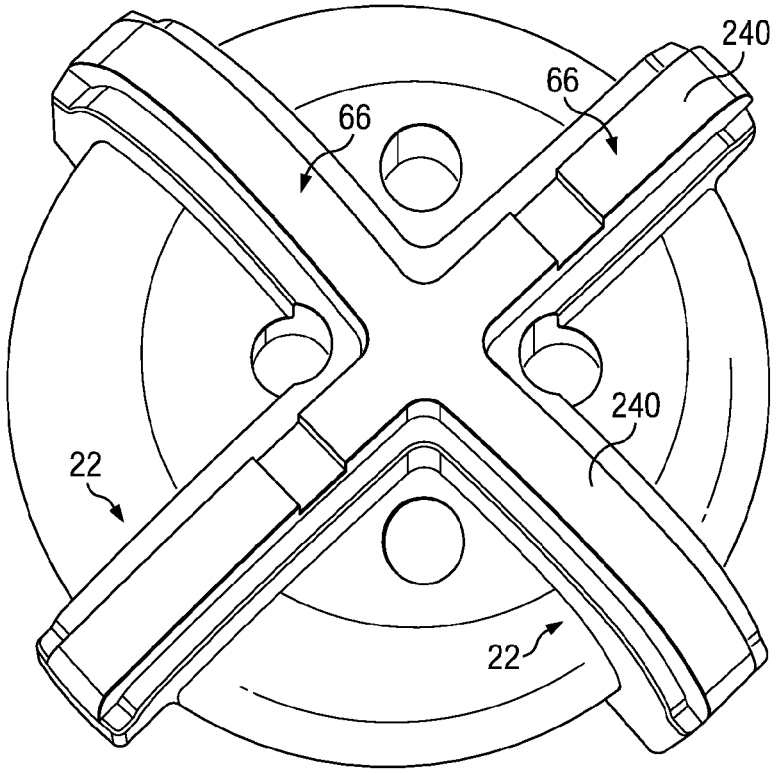

FIG. 6 illustrates a perspective view of an impregnated drill bit including a plurality of blade structures 22, with an abrasive segment 66 mounted to each blade. Each segment 66 curves with the face of the bit and is comprised by an impregnated structure 240. The structure 240 may be attached to the body of the drill bit, and more specifically attached to the supporting blade structure, using brazing or furnacing techniques known to those skilled in the art.

Figure 7:
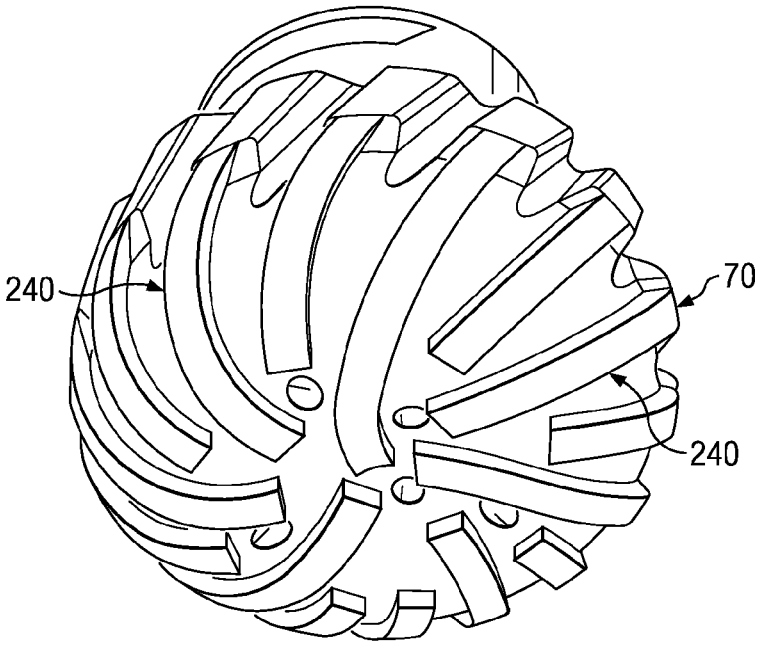

FIG. 7 illustrates a perspective view of an impregnated drill bit including a plurality of discrete structures 240 attached to a body of the drill bit. In particular, the structures 240 are shown to form blade structures 70. The structure 240 may be attached to the body of the drill bit using brazing or furnacing techniques known to those skilled in the art. In this implementation, the constructs are formed with a depth sufficient to define the desired blade height. Although shown with a spiral blade configuration, it will be understood that the blade structures formed by the impregnated diamond construct segments could instead have a straight configuration.

In accordance with an embodiment of the invention, a drill bit includes a plurality of continuous spiral segments impregnated with diamond (i.e., structures 240) that are mounted to form spiraled blades. The regions between the spiraled blades define a plurality of fluid passages on the bit face. The spiraled blades may extend radially outwardly to the gage to provide increased blade length and enhanced cutting structure redundancy and diamond content.

Alternatively, an embodiment of a drill bit includes a plurality of continuous straight segments impregnated with diamond (i.e., structures 240) that are mounted to form straight blades. The regions between straight blades define a plurality of fluid passages on the bit face. The straight blades may extend radially outwardly to the gage.

Each segment for a blade can be mounted on either a matrix body bit/tool or steel body bit/tool, and are preferably attached to the body by brazing, furnacing and/or mechanically by dovetail assembly, hexnut or shape memory which will allow for the ease of repair.

Figure 8A:
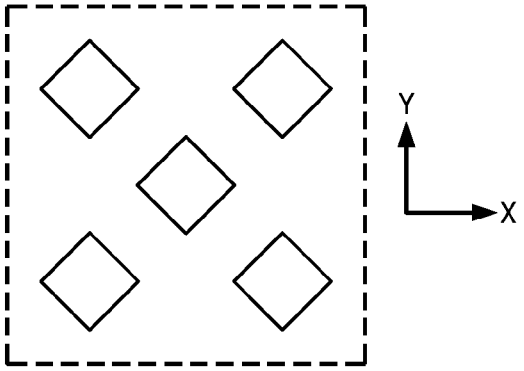
FIGS. 8A-8B illustrate examples of a regular and repeating layout of super-abrasive particles.
Figure 8B:
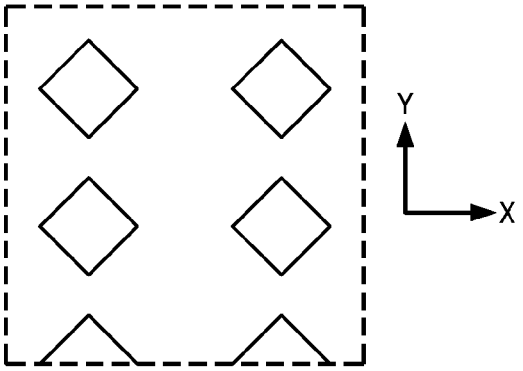

Reference is now made to FIGS. 8A and 8B which illustrate examples of a regular and repeating layout of super-abrasive particles 180. The illustrations in FIGS. 8A and 8B are plan views. It will be understood that the layouts of FIGS. 8A and 8B are exemplary only, and that other regular and repeating patterns could alternatively be chosen. It will further be understood that the geometric precision of the regular and repeating layout of super-abrasive particles 180 shown in FIGS. 8A and 8B is not a requirement. Rather, the super-abrasive particles 180 should be laid out in a manner as closely approaching the illustrated geometric precision as is possible. Slight variations in position of the diamonds are acceptable so long as it is clear that the super-abrasive particles 180 have been laid out with a regular and repeating pattern that is clearly distinct from a random distribution like that used in the prior art.

The structures 240 of the present invention may be brazed into a cast bit body of a tool such as drill bit. The locations for attachment of the structures 240 to the bit body may be precisely designed so that the resulting tool possesses superior and predictable target material cutting capabilities. These bits last longer, cut faster, and more efficiently use the deployed diamond materials when compared to typical prior art impregnated constructs with randomly distributed diamond.

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. Apparatus, comprising:

a fused unitary matrix body embedding plural layers of super-abrasive particles and forming a blade of an earth boring drill bit;

wherein each layer of super-abrasive particles comprises a plurality of super-abrasive particles arranged in the layer with a non-random distribution; and wherein the fused unitary matrix body has a side surface which is non-parallel to each layer of super-abrasive particles, said side surface being an abrading surface.

2. The apparatus of claim 1, wherein the side surface is perpendicular to each layer of super-abrasive particles.

3. The apparatus of claim 1, wherein the super-abrasive particles are selected from the group consisting of: diamond particles, thermally stable polycrystalline diamond particles, and cubic boron nitride particles.

4. The apparatus of claim 1, wherein the non-random distribution comprises a regular and repeating pattern distribution of super-abrasive particles.

5. The apparatus of claim 1, wherein the layers of super-abrasive particles are separated from each other by fused matrix powder having a non-uniform component distribution.

6. The apparatus of claim 1, wherein the fused unitary matrix body is formed of tungsten carbide.

7. The apparatus of claim 1 wherein the layers of super-abrasive particles are separated from each other by a matrix material having a non-uniform component distribution to create a varying wear rate of the fused unitary matrix body.

8. The apparatus of claim 7 wherein the varying wear rate varies along a length of the blade from a leading edge of the blade to a trailing edge of the blade.

9. The apparatus of claim 7 wherein the blade is either a spiral blade or a straight blade.

10. The apparatus of claim 7 wherein the matrix material is tungsten carbide and the fused unitary matrix body comprises a region that is relatively richer in tungsten and another region that is relatively richer in carbide.

11. Apparatus, comprising:

a plurality of layers of super-abrasive particles, wherein each layer of super-abrasive particles comprises a plurality of super-abrasive particles arranged in the layer with a non-random distribution;

a fused unitary matrix body which embeds the plurality of layers of super-abrasive particles in a manner where the layers are separated from each other and generally arranged to be parallel to each other, said fused unitary matrix body presenting an abrading side surface, the fused unitary matrix body being attached to a blade structure of an earth boring drill bit.

12. The apparatus of claim 11, wherein the abrading side surface is perpendicular to each layer of super-abrasive particles.

13. The apparatus of claim 11, wherein the super-abrasive particles are selected from the group consisting of: diamond particles, thermally stable polycrystalline diamond particles, and cubic boron nitride particles.

14. The apparatus of claim 11, wherein the non-random distribution within each layer comprises a regular and repeating pattern distribution of super-abrasive particles.

15. The apparatus of claim 11, wherein the layers of super-abrasive particles are separated from each other by fused matrix powder having a non-uniform component distribution.

16. The apparatus of claim 11, wherein the fused unitary matrix body is formed of tungsten carbide.

17. The apparatus of claim 11, wherein the fused unitary matrix body is formed from a tungsten carbide matrix powder exhibiting a non-uniform component distribution such that the fused unitary matrix body comprises a region that is relatively richer in tungsten and another region that is relatively richer in carbide.

18. The apparatus of claim 11 wherein the layers of super-abrasive particles are separated from each other by a matrix material having a non-uniform component distribution to create a varying wear rate of the fused unitary matrix body.

19. The apparatus of claim 18 wherein the varying wear rate varies along a length of the blade from a leading edge of the blade to a trailing edge of the blade.

20. The apparatus of claim 18 further comprising a plurality of discrete fused unitary matrix bodies attached to the blade structure to form a blade of the earth boring drill bit.

21. The apparatus of claim 18 wherein the matrix material is tungsten carbide and the fused unitary matrix body comprises a region that is relatively richer in tungsten and another region that is relatively richer in carbide.

22. Apparatus, comprising:

a plurality of layers of super-abrasive particles, wherein each layer of super-abrasive particles comprises a plurality of super-abrasive particles arranged in the layer with a non-random distribution; and a fused unitary tungsten carbide matrix body which embeds the plurality of layers of super-abrasive particles, the layers being separated from each other and generally arranged to be parallel to each other;

wherein the fused unitary tungsten carbide matrix body embeds one of the layers with matrix material that is relatively richer in tungsten and embeds another one of the layers with matrix material that is relatively richer in carbide.

23. The apparatus of claim 22, wherein the non-random distribution within each layer comprises a regular and repeating pattern distribution of super-abrasive particles.

24. The apparatus of claim 22, wherein the fused unitary tungsten carbide matrix body presents an abrading side surface oriented generally perpendicular to said layers of super-abrasive particles.

25. The apparatus of claim 22, wherein the super-abrasive particles are selected from the group consisting of: diamond particles, thermally stable polycrystalline diamond particles, and cubic boron nitride particles.

26. The apparatus of claim 22 wherein the fused unitary tungsten carbide matrix body forms at least a portion of a blade of an earth boring drill bit.

27. The apparatus of claim 26 wherein a wear rate of the fused unitary matrix body varies along a length of the blade from a leading edge of the blade to a trailing edge of the blade.

* * * * *